US005591948A

United States Patent [19]

Bolongeat-Mobleu et al.

[11] Patent Number: 5,591,948

[45] Date of Patent: Jan. 7, 1997

[54] VACUUM CARTRIDGE, NOTABLY FOR A MEDIUM VOLTAGE ELECTRICAL CICUIT BREAKER OR SWITCH AND A SWITCH INCORPORATING SUCH A CARTRIDGE

[75] Inventors: Roger Bolongeat-Mobleu; Frédéric Burnaz, both of Echirolles; Hans Schelleken, Meylan, all of France

[73] Assignee: Schneider Electric S.A., France

[21] Appl. No.: 466,735

[22] Filed: Jun. 6, 1995

[30] Foreign Application Priority Data

Jun. 20, 1994 [FR] France ..... 94 07615

[51] Int. Cl.[6] ..... H01H 33/66; H01H 33/04

[52] U.S. Cl. ..... 218/68; 218/3; 218/10; 218/123; 218/142

[58] Field of Search ..... 218/2–7, 8–10, 218/22, 42, 68, 70, 118, 121, 123, 124, 125, 126, 129, 127, 134, 135, 136, 141, 142

[56] References Cited

U.S. PATENT DOCUMENTS

| | | | |
|---|---|---|---|
| 3,210,505 | 10/1965 | Porter | 218/118 |
| 3,211,866 | 10/1965 | Crouch et al. | 218/126 |
| 4,171,474 | 10/1979 | Holmes | 218/123 |
| 5,155,315 | 10/1992 | Malkin | 218/3 |
| 5,239,149 | 8/1993 | Malkin et al. | 218/142 |
| 5,280,144 | 1/1994 | Bolongeat-Mobleu et al. | 218/70 |
| 5,347,096 | 8/1994 | Bolongeat-Mobleu et al. | 218/84 |

FOREIGN PATENT DOCUMENTS

| | | | |
|---|---|---|---|
| 0433184 | 6/1991 | European Pat. Off. | H01H 33/66 |
| 1353284 | 1/1964 | France | H01H 33/66 |
| 1226693 | 5/1967 | Germany | H01H 33/12 |
| 1806880 | 9/1969 | Germany | H01H 33/66 |

*Primary Examiner*—J. R. Scott

*Attorney, Agent, or Firm*—Parkhurst, Wendel & Burr, L.L.P.

[57] ABSTRACT

A vacuum cartridge for a medium voltage electrical switch, as well as a switch incorporating such a cartridge comprising an enclosure closed by two end-plates in which there are housed three contacts extending axially. Two of these contacts are stationary and comprise a disk-shaped contact part and are securely fixed respectively to the two end-plates, whereas the third contact is formed by a rod slidably mounted in the second stationary contact, the rod being brought into contact with the first stationary contact during a period sufficient to generate an electrical arc between the two stationary contacts in order to perform breaking of an electrical circuit. A switch comprises an enclosure filled with sulphur hexafluoride including a cartridge as previously described, two main contacts electrically connected in parallel to the stationary contacts and an operating mechanism connected to selected aformentioned contacts.

8 Claims, 2 Drawing Sheets

VACUUM CARTRIDGE, NOTABLY FOR A MEDIUM VOLTAGE ELECTRICAL CICUIT BREAKER OR SWITCH AND A SWITCH INCORPORATING SUCH A CARTRIDGE

BACKGROUND OF THE INVENTION

The present invention relates to a vacuum cartridge designed to break an electrical circuit in a medium voltage circuit breaker or switch, as well as a switch incorporating such a cartridge.

An electrical switch with a vacuum cartridge is already known described in U.S. Pat. No. 5,155,315, mainly comprising a sealed enclosure filled with a high dielectric strength gas, in which a vacuum cartridge is arranged containing a pair of arcing contacts, one stationary and the often movable, a pair of main contacts electrically connected in parallel to the arcing contacts, and an operating mechanism connected to the contacts to open the arcing contacts after the main contacts, and to close the arcing contacts before the main contacts. The two above-mentioned arcing contacts each comprise a disk-shaped contact part. The stationary contact is securely fixed to one of the end-plates of the enclosure whereas the movable contact is slidably mounted in the other of the two end-plates of the enclosure and is connected to the operating mechanism in order to achieve breaking of the electrical circuit.

Although the above-described vacuum cartridge is satisfactory in a general sense, it does nevertheless have certain drawbacks. For example, when closing of the contacts takes place, the two disks are rarely exactly parallel to one another. It is therefore difficult to obtain an immediate contact over the whole surface of the disks, thereby concentrating the electrical arc at the circumference of the disks, and reducing the breaking capacity. Another drawback is that the force required to maintain contact between the two disks is great and requires the use of a consequent operating mechanism.

SUMMARY OF THE INVENTION

The present invention overcomes these drawbacks and proposes a vacuum cartridge of simple design for a medium voltage electrical switch or circuit breaker, enabling an improved breaking capacity to be achieved due to a more uniform distribution of he arc produced between the two arcing contacts, and at the same time resulting in reduced manufacturing cost.

An object of the present invention is to provide a vacuum cartridge for a medium voltage electrical circuit breaker or switch, comprising an enclosure of appreciably cylindrical shape closed by two end-plates electrically connected respectively to two main contacts of the two contacts extending axially inside the enclosure, one of the contacts being fixed to one of the above-mentioned end-plates whereas he other, movable, contact is slidably mounted with respect to the other of the two end-plates and is connected to a mechanism which moves the movable contact between a closed position of the stationary and movable contacts and a separated position of the two contacts whereby an electrical circuit is broken. The cartridge further comprises a second stationary contact, securely united to the above-mentioned second end-plate and in which a rod, forming the above-mentioned movable contact, is slidingly mounted, the rod being brought into contact with the first stationary contact, then separated from this contact to generate a uniform electrical arc between the two above-mentioned stationary contacts, and to achieve breaking of the electrical circuit.

According to a particular embodiment of the invention, the above-mentioned first and second stationary contacts each comprise a disk-shaped contact part, the two parts being appreciably of the same diameter and located facing one another.

According to a particular feature, the second stationary contact comprises two cylindrical parts, respectively upper and lower, of different diameters, the upper part of larger diameter forming the above-mentioned contact part.

According to another feature, the above-mentioned upper part comprises an orifice for guiding the above-mentioned rod in translation, whereas the above-mentioned lower part comprises a recess for housing a sealing bellows fitted around the rod.

According to another feature, the vacuum cartridge comprises means for producing an axial magnetic field in the art formation zone.

According to a particular feature, the vacuum cartridge comprises a ceramic enclosure of appreciably cylindrical shape closed by two metallic end-plates electrically connected to the two contacts of the switch.

According to an alternative embodiment, the vacuum cartridge comprises a plate made of ceramic or similar, onto which are fixed the second stationary contact and a cup closed by a cover onto which the above-mentioned first stationary contact is fixed, the cup and cover being made of conducting material and the two stationary contacts being electrically connected respectively to the two contacts of the switch.

Preferably the above-mentioned first and second stationary contacts and rod are made of refractory material.

Another object of the invention is provide an electrical switch comprising a sealed enclosure filled with sulphur hexafluoride, in which a vacuum cartridge is arranged comprising the features described either taken one by one or in combination, a pair of main contacts electrically connected in parallel to said arcing contacts, and an operating mechanism to open the arcing contacts after the main contacts and to close the arcing contacts before the main contacts.

BRIEF DESCRIPTION OF THE DRAWINGS

Other advantages and features of the invention will become more clearly apparent from the following detailed description which refers to the accompanying drawings given an non-restrictive examples only and in which.

DETAILED DESCRIPTION OF THE PREFERRED EMBODIMENT

Figure 1:
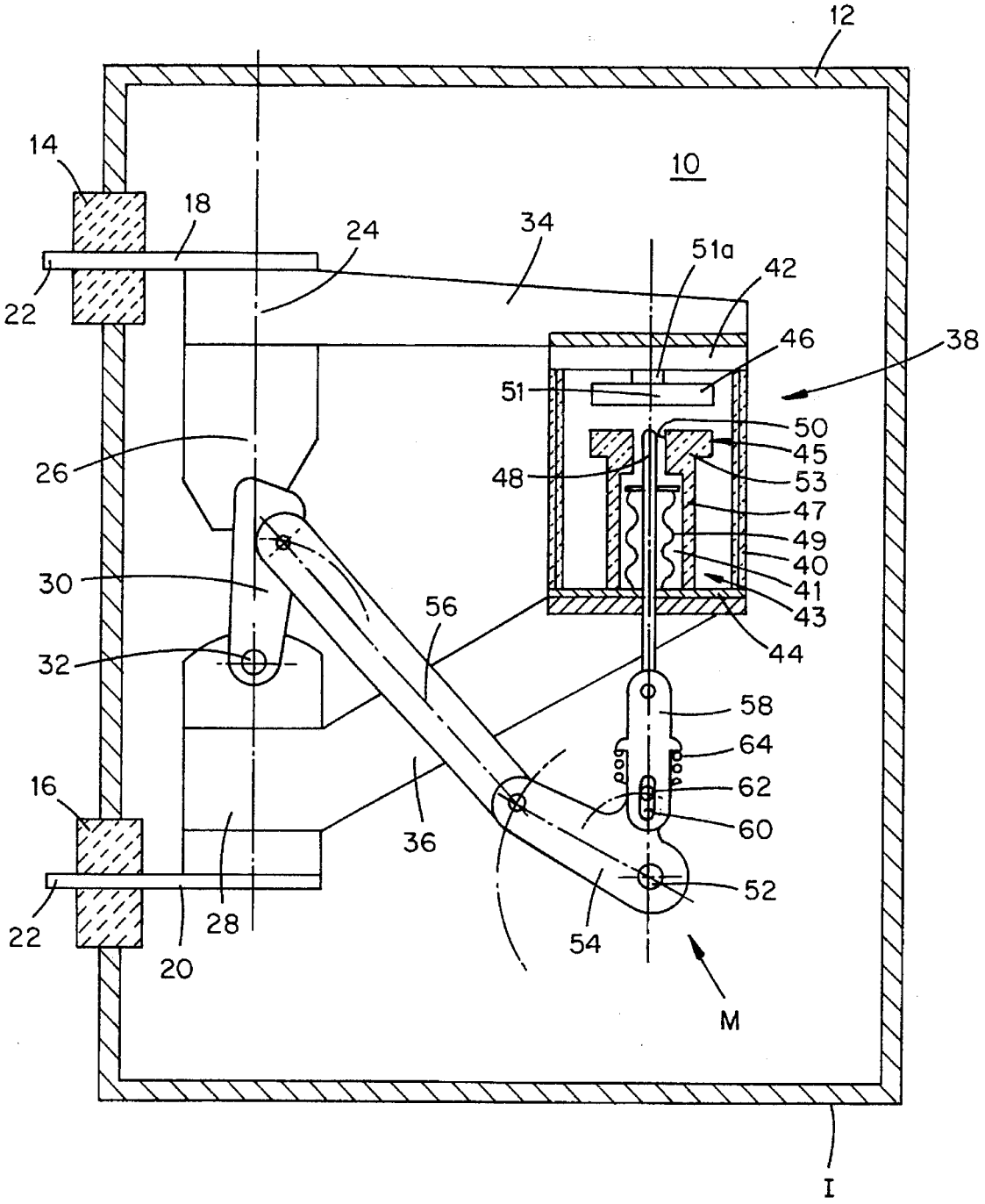
FIG. 1 is a schematic axial sectional view of a circuit breaker incorporating a vacuum cartridge, according to a particular embodiment of the invention.

In FIG. 1, a vacuum cartridge 38 according to a first embodiment of the invention can be seen used in a circuit breaker. This figure corresponds to that of the above-mentioned U.S. Pat. No. 5,155,315 and the medium voltage circuit breaker with sealed enclosures 10 can be recognized, whose metal or insulating wall 12 may be that of a gas-insulated installation or substation, or that of a pole-unit or of the three pole-units of the circuit breaker. The pole-unit represented in FIG. 1 comprises two tight bushings 14, 16 of a current input conductor 18 and a current output conductor 20, which are terminated outside the enclosure 10 by connecting strips 22 and inside respectively by a support 24 of a stationary main contact 26 and by a support 28 of a movable main contact 30 in the form of a knife-blade pivotally mounted on a fixed spindle 32. In the closed position the movable main contact 30 is aligned and in contact with the stationary main contact 26 to close the main circuit formed by the input conductor 18, support 24, stationary main contact 26 and movable main contact 30, support 28 and output conductor 20. The supports 24, 28 are extended by arms 34, 36 extending transversely and surrounding the vacuum cartridge 38 by their free ends. The cylindrical enclosure 40 of the cartridge 38 is sealed off tightly at each ends by metal end-plates 42, 44 each mechanically and electrically connected to the free end of the associated arm 34, 36. The axis of the cartridge is appreciably parallel to the aligned main contacts 26, 30 in the closed position and three contacts 46, 47, 48 are arranged coaxially in the cartridge 38.

The first contact 46 is stationary and is formed by a disk-shaped contact part 51, supported by a rod 51*a* fixed onto the upper end-plate 42 of the enclosure 40. This enclosure 40 also comprises a second stationary contact 47 formed by two cylindrical parts, respectively upper part 45 and lower part 43, of different diameters. The upper part 45 forms another disk-shaped contact part 53, whose diameter corresponds to that of the first stationary contact 51. whereas the lower part 43 is fixed at its base onto the lower end-plate 44 of the enclosure 40. The upper part 45 comprises a cylindrical recess 50 in which a rod 48 constituting the third contact is slidaby mounted. The lower part 43 of the second stationary contact 47 comprises a recess 41 designed to house a sealing bellows 49 mounted around the rod 48. It can easily be seen that the arms 34, 36, end-plates 42, 44 and arcing contacts 46, 48 form an auxiliary arcing circuit connected in parallel to the main contacts 26, 30.

A rotary operating shaft 52 passes through the wall 12 and bears at its internal end a crank 54 connected on the one hand by an articulated connecting rod 56 to the main knife-blade 30 and on the other hand by a connecting rod 58 and button-hole aperture 60 to the rod 48. In the button-hole aperture 60 arranged in the connecting rod 58, there is slidably mounted a crankpin 62 supported by the crank 54 in such a way as to form a dead travel link biased in extension by a spring 64. The mechanism is arranged in such a way that in the course of an opening operation of the circuit breaker, brought about by clockwise rotation of the shaft 52, the movable main contact 30 opens first, while the arcing contacts 46, 48 remain preliminarily closed due to the dead travel 60, 62. The current which was flowing via the main contacts 6 30 is switched into the arcing circuit without an arc forming on the main contacts 26, 30. Continued rotation of the shaft 52 separates the arcing contacts 46, 48 and opens the circuit breaker. The closing operation, brought about by a reverse rotation of the shaft 52, first closes the arcing contacts 46, 48, and then the main contacts 26, 30.

The cylindrical enclosure 40 of the vacuum cartridge 38 is made of ceramic or glass with a smooth external surface, whose axial length defines the critical creepage distance of the cartridge 38. This axial length is determined according to the voltage, to ensure a sufficient dielectric withstand and this length is notably smaller than that of a cartridge placed in air. In medium voltage applications this length is smaller than or close to 15 cm and the reduced dimensions of the vacuum cartridge 38 make the latter easier to house.

The end-plate 42 of the cartridge 38 located on the same side as the stationary contact 46 bears on its face internal to the cartridge 38 a coil (not represented) coaxial to the enclosure 40 and electrically connected in series with the arcing contacts 46, 48. The coil procedures an axial magnetic field between the arcing contacts 46, 48 designed to diffuse the electrical arc in order to improve the breaking capacity.

In operation, when the main contacts 26, 30 are opened by clockwise rotation of the operating shaft 52, the stationary contact 46 and movable contact 48 are first of all closed, then reopened so as to create an electrical arc between the two stationary contacts 46, 47 achieving breaking of the electrical circuit. In this embodiment, since there is almost pinpoint contact between the stationary contact 46 and the movable contact 48, the electrical arc diffused by the magnetic field is distributed uniformly between the two stationary contacts 46, 47, which improves he breaking capacity of the circuit breaker.

Figure 2:
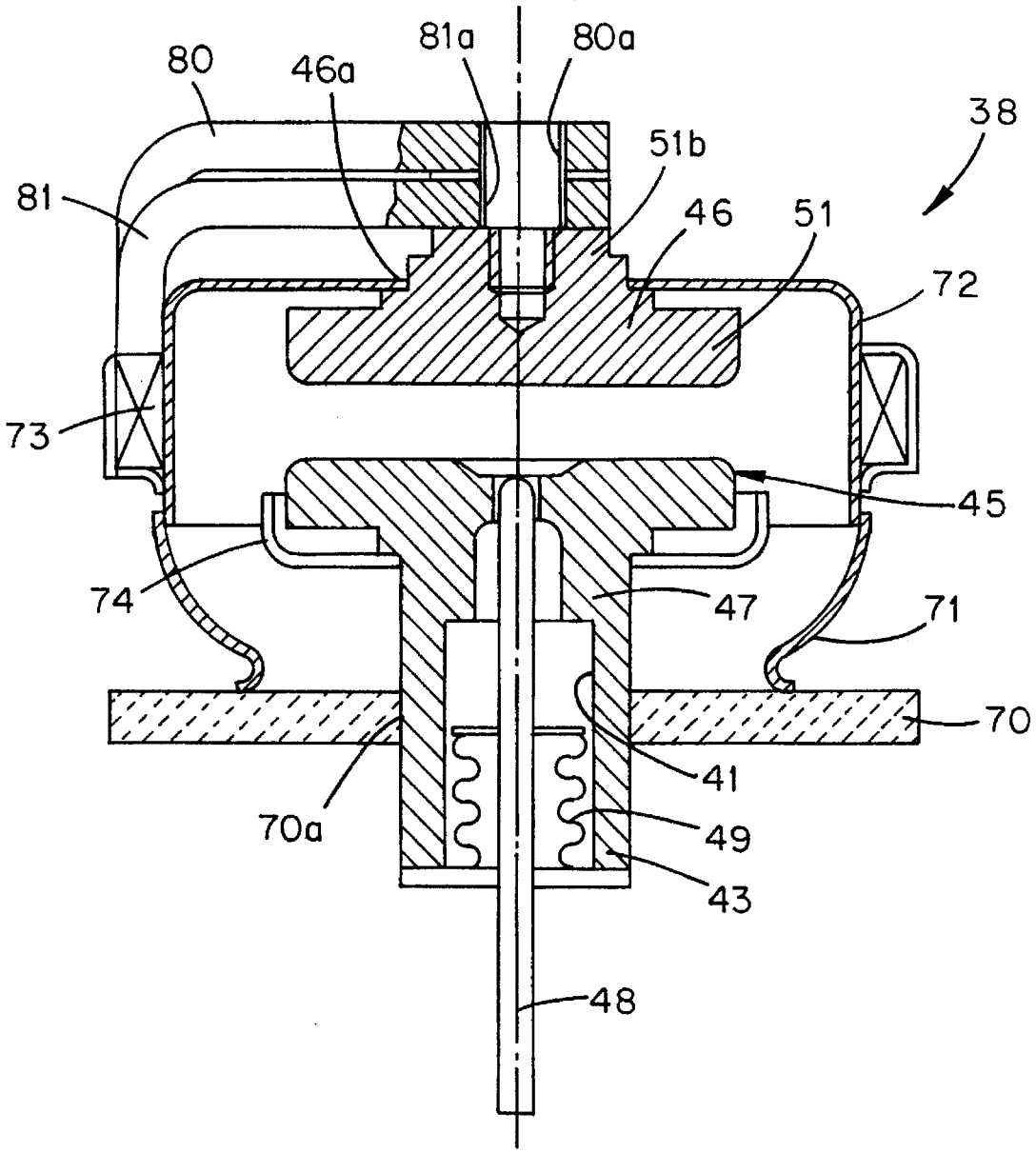
FIG. 2 is an axial sectional view of an alternative embodiment of the vacuum cartridge.

Referring now to FIG. 2, another embodiment of the invention can be seen, according to which the cartridge enclosure is formed by a ceramic plate 70, on which a metallic cup 71 is brazed closed by a cover 72 which is also metallic. The ceramic plate 70 comprises an orifice 70*a* onto whose edges the lower parts 43 of the second stationary contact 47, whose shape corresponds to that described previously, is welded. The first stationary contact 46 comprises a disk-shaped contact part 51, and a staggered part 51*b*, welded onto the edge of an orifice 46*a* arranged in the above-mentioned cover 72, around which cover a coil 73 is fixed. The cup 74 is designed to protect the ceramic plate 70 against plasma projections when formation of the arc occurs.

The coil 73 is a single turn of rectangular cross-section having two ends 80, 81 extending upwardly and parallel to and then radially with respect to a longitudinal axis of the vacuum cartridge 38. Arm 34 is electrically connected to end 80 and end 81 is electrically connected to first stationary contact 51. Ends 80, 81 are not in contact with each other and include holes 80*a*, 81*a*, respectively, for accepting a fixing screw (not shown) thereby permitting simple fixation of the coil 73 to the vacuum cartridge 38.

When this cartridge is used in a circuit breaker such as previously described, one of the main contacts 26 of the circuit breaker is electrically connected via the arm 34 to the coil 73, whereas the other main contact 30 is electrically connected via the arm 36 to the second stationary contact 47 constituting one of the end-plates 44 of the cartridge, the rod 48 being connected as previously described to the connecting rod 58.

Operation of this cartridge is the same as that corresponding to the first embodiment of the cartridge and will therefore not be described.

A vacuum cartridge of simple design, and also a switch or circuit breaker whose breaking capacity is improved due to the more homogeneous distribution of the electrical arc between the stationary contacts, has therefore been achieved by means of the invention. Moreover, this cartridge has a reduced manufacturing cost since requires a smaller operating mechanism due to the fact than the movable contact is reduced to a single rod.

The invention is naturally in no way limited to the embodiments described and illustrated which have been given as examples only.

Thus, for example, other types of coils could be used, or other shapes envisaged for the stationary contacts.

Furthermore, the invention includes all the technical equivalents of the means described, as well as their combinations if the latter are achieved in accordance with the spirit of the invention.

We claim:

1. A vacuum cartridge for a medium voltage electrical circuit breaker or switch, comprising:

an enclosure of appreciably cylindrical shape having a first and a second end plate;

first and second stationary arcing contacts fixed axially inside said enclosure and fixed to said first and second end-plates respectively;

a movable contact, including a rod, slidably mounted with respect to said second end plate and slidably mounted in said second stationary arcing contact;

means connected to said movable contact for moving said movable contact between a closed position wherein said movable contact contacts said first stationary arcing contact and a separated position wherein said movable contact is separated from said first stationary arcing contact; and means for producing an axial magnetic field in an arc formation zone between said first and second stationary arcing contacts, whereby an electrical arc, generated when said movable contact is separated from said first stationary contact, is uniformly distributed by said axial magnetic field during a breaking of an electrical circuit.

2. The vacuum cartridge according to claim 1, wherein said first and second stationary arcing contacts face one another and each comprises a disk-shaped contact part having appreciably the same diameter.

3. The vacuum cartridge according to claim 2, wherein said second stationary arcing contact comprises two cylindrical parts, respectively upper and lower, of different diameters, the upper part of larger diameter forming the contact part of said second stationary arcing contact.

4. The vacuum cartridge according to claim 3, wherein said upper part comprises an orifice for guiding the rod and the lower part comprises a recess for housing a sealing bellows fitted around the rod.

5. The vacuum cartridge according to claim 1, wherein said enclosure is ceramic, said first and second end plates are metallic, and said end-plates are electrically connected, respectively, to first and second contacts of said switch.

6. The vacuum cartridge according to claim 1, comprising a plate made of ceramic to which is fixed said second stationary arcing contact and a cup closed by a cover to which said first stationary arcing contact is fixed, the cup and cover being made of conducting material and said first and second stationary arcing contacts being electrically connected respectively to first and second contacts of said switch.

7. The vacuum cartridge according to claim 1, wherein said first and second stationary arcing contacts and the rod are made or refractory material.

8. A circuit breaker or switch, comprising:

a sealed enclosure filled with a high dielectric strength gas;

a vacuum cartridge comprising:

an enclosure of appreciably cylindrical shape having a first and a second end plate;

first and second stationary arcing contacts fixed axially inside said enclosure and fixed to said first and second end-plates respectively;

a movable contact, including a rod, slidably mounted with respect to said second end plate and slidably mounted in said second stationary arcing contact;

means connected to said movable contact for moving said movable contact between a closed position wherein said movable contact contacts said first stationary arcing contact and a separated position wherein said movable contact is separated from said first stationary arcing contact; and means for producing an axial magnetic field in an arc formation zone between said first and second stationary arcing contacts, whereby an electrical arc, generated when said movable contact is separated from said first stationary contact, is uniformly distributed by said axial magnetic field during a breaking of an electrical circuit;

a pair of main contacts electrically connected in parallel to said arcing contacts; and an operating mechanism to open said contacts after the main contacts and to close said contacts before the main contacts.

* * * * *